United States Patent [19]

Wilford

[11] 4,261,466

[45] Apr. 14, 1981

[54] RETENTION OF ARTICLES ON A SHEET

[75] Inventor: William P. Wilford, Northampton, England

[73] Assignee: The Mettoy Company Limited, Northampton, England

[21] Appl. No.: 44,253

[22] Filed: May 31, 1979

[51] Int. Cl.[3] ..... B65D 85/68

[52] U.S. Cl. ..... 206/335; 206/480; 206/482; 206/489; 248/503; 24/73 RM

[58] Field of Search ..... 206/477, 478, 480, 481, 206/482, 483, 488, 489, 490, 335; 248/503, 499, 500; 24/73 RM, 258

[56] References Cited

U.S. PATENT DOCUMENTS

| | | | |
|---|---|---|---|
| 689,377 | 12/1901 | Beiser | 206/45.14 |
| 938,739 | 11/1909 | Beetham | 248/346 |
| 2,352,806 | 7/1944 | Schwartz | 248/346 |
| 3,010,673 | 11/1961 | Marconi | 220/94 R |
| 3,423,059 | 1/1969 | Kahn | 206/478 |
| 3,576,253 | 4/1971 | Keats et al. | 206/45.14 |
| 3,811,565 | 5/1974 | Tancredi | 206/478 |
| 3,927,765 | 12/1975 | Beal | 206/481 |

*Primary Examiner*—Joseph Man-Fu Moy
*Attorney, Agent, or Firm*—Watson, Cole, Grindle & Watson

[57] ABSTRACT

An assembly of an article, for example a toy vehicle, retained on a sheet comprises a holding device securing the article on an upper surface of the sheet and having depending legs which extend through corresponding apertures in the sheet and in a body portion of a retaining device the body portion being located on the lower side of the sheet. The legs have respective transverse projections which project over and lie adjacent the lower surface of the body portion to hold the article on the sheet. The apertures of the body portion include opposed aperture portions through which the projections can pass during assembly and circumferentially extending aperture portions along which the legs can ride, upon rotation of said retaining device, to bring the legs out of alignment with said opposed aperture portions and into positions adjacent the lower surface of the body portion.

9 Claims, 3 Drawing Figures

RETENTION OF ARTICLES ON A SHEET

This invention relates to the retention of articles on a sheet and is particularly, but not exclusively, applicable to retaining toy models for packaging.

Previously, toy models, for example toy vehicles, have been packaged in cartons which comprise a flat base sheet of cardboard and a plastics cover which shrouds the model and is secured to the base sheet. Difficulty has, however, been experienced in positioning the models on the sheet while the plastic cover is located and attached to the sheet, and in retaining the models, particularly relatively heavy models, in the finished cartons.

In accordance with one aspect of the present invention, there is provided an assembly of an article retained on a sheet, comprising holding means securing said article on an upper surface of the sheet and having depending legs which extend through corresponding apertures in the sheet and in a body portion of a retaining means, the body portion being located on the lower side of the sheet, wherein said legs have respective transverse projections which project over and lie adjacent the lower surface of the body portion to hold the article on the sheet.

The article may be a toy motor cycle, in which case the legs and projections may be provided by a stand or support of the cycle.

Alternatively, the projections may be formed on a holding member having a main portion which embraces the article and outwardly directed end portions which constitute said projections.

In accordance with another aspect of the invention, there is provided a retaining means for use in retaining an article on a sheet, comprising a body portion having two opposed apertures, each aperture comprising a circumferentially extending portion and a portion extending transversely of said circumferentially extending portion.

Figure 1:
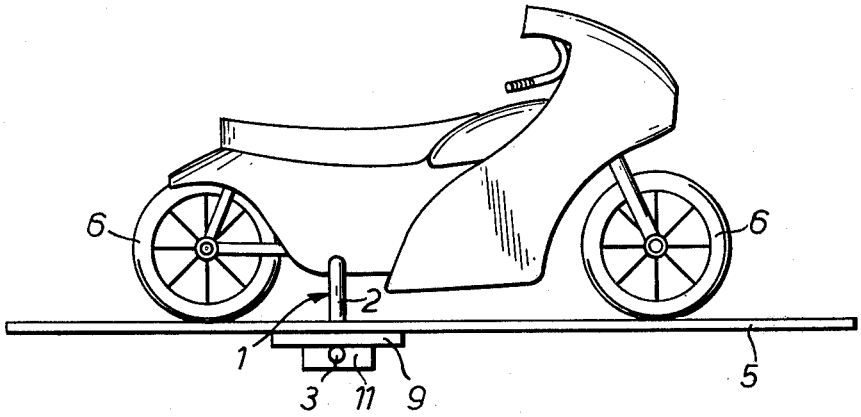
Figure 3:
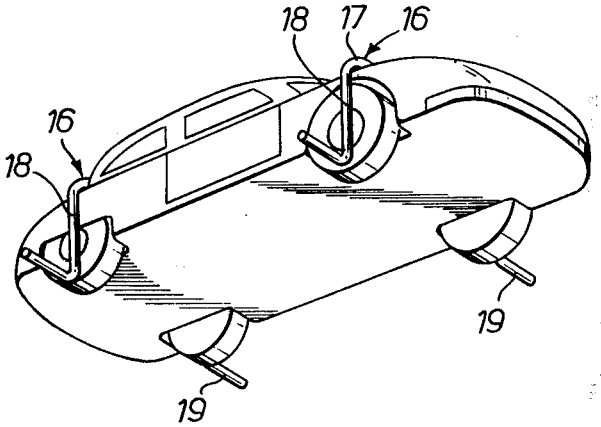
Figure 2:
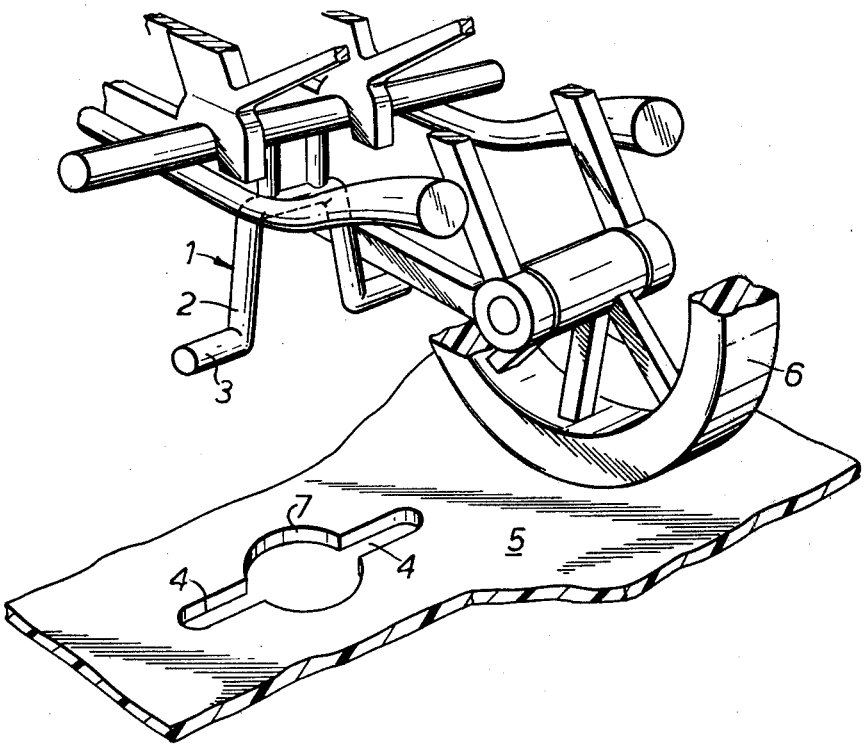
Figure 2:
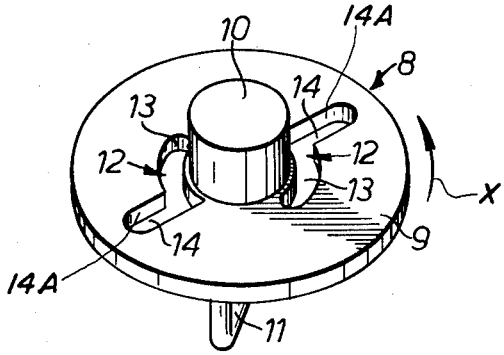

Two forms of assembly in accordance with the invention of an article retained on a sheet will now be described, by way of example, with reference to the accompanying drawings, in which:

FIG. 1 is an elevational view of one form of assembly in which the article is a toy motor cycle, FIG. 2 is an enlarged, exploded view of the assembly of FIG. 1, but with parts omitted and cut away for clarity, and FIG. 3 is a perspective view of part of the other form of assembly in which the article is a toy car.

Referring to FIGS. 1 and 2, the motor cycle has a stand 1 having legs 2 which extend downwardly from the motor cycle and elongate projections or feet 3 which extend transversely to the legs 2. The stand 1 is normally pivotable about a transverse axis of the cycle to enable the stand to be moved upwardly out of its illustrated position.

The projections 3 are inserted through complementary elongate apertures 4 in the sheet 5, which forms the base of a package or box for the motor cycle, and the wheels 6 of the motor cycle engage the upper surface of the sheet. A locating aperture 7 in the sheet joins the apertures 4.

A retainer 8 of plastics material has a main body portion 9 in the form of a disc, the portion 9 having a central locating boss 10 extending from the top surface thereof and a grippable part 11 upstanding from the opposite, lower surface thereof. Diametrically opposed apertures 12 are formed in the the body portion 9, each aperture having a circumferentially extend portion or slot 13 and an elongate, radially extending portion 14 through which a projection 3 can pass.

To retain the motor cycle on the sheet the retainer 8 is positioned so that the boss 10 engages in locating aperture 7 in the sheet and the stand projections 3 are aligned respectively with the radial portions 14 of the apertures 12. The disc part is then pushed into engagement with the lower surface of sheet 5 with the projections 3 protruding through the apertures 12. In this position the legs 2 of the stand 1 are circumferentially aligned respectively with the slots 13 of apertures 12 and rotation of the retainer 8 in the direction of arrow X (FIG. 2) causes the legs 2 to ride in the slots 13, the feet 3 engaging the bottom surface of the body portion 9 to hold the motor cycle on the sheet.

If desired the sides 14A of the radial aperture portions 14 may be chamfered to provide a ramp which assists in the passage of the projections 3 when the retainer is rotated.

FIG. 3 illustrates how other articles, for example a toy car 15, may be retained on a sheet using one or more holding clips 16. The sheet and retainer are not illustrated in FIG. 3, but are substantially the same as those described above.

Each clip 16 serves the same function as the stand 1 of the motorcycle described above and comprises a body portion 17, downwardly depending legs 18 and outwardly extending projections 19 the body portion 17 is so shaped to embrace the article and hold it in place.

In use the projections 18 co-operate with apertures in the sheet and the retainer in the same way as the projections 3 of the above described assembly and further description is not needed here.

I claim:

1. An assembly of an article on a sheet, comprising retaining means having a body portion on a lower portion of said sheet, said body portion having opposed aperture portions and circumferentially extending apertures, said sheet having apertures aligned with said opposed aperture portions, and holding means securing the article on the upper side of said sheet, said holding means having depending leg means which extend through said aligned apertures and opposed aperture portions, transverse projections on said leg means, said leg means riding along said circumferentially extending aperture portions upon rotation of said retaining means so as to bring said leg means out of alignment with said opposed aperture portions and said projections into position lying adjacent the lower surface of said body portion to thereby hold the article on said sheet.

2. An assembly according to claim 1, wherein said opposed aperture portions in said body portion of said retaining means are of a shape complementary to said projections.

3. An assembly according to claim 2, wherein said opposed aperture portions are located respectively at the ends of said circumferentially extending portions and extend radially outwardly therefrom.

4. An assembly according to claim 1, wherein said retaining means has a locating boss on its upper surface which co-operates with a complementary shaped aperture in the sheet thereby to properly locate said retaining means relative to said sheet.

5. An assembly according to claim 4, wherein said aperture in said sheet which receives said boss interconnects said apertures through which the legs extend.

6. An assembly according to claim 1, wherein said retaining means has a grippable portion extending from the lower surface of said body portion.

7. An assembly according to claim 1, wherein said apertures in said sheet through which said legs extend are of a shape complementary to said projections.

8. An assembly according to claim 1, wherein said article is a toy motorcycle having a stand and said holding means comprise said stand of said motorcycle.

9. An assembly according to claim 1, wherein said holding means comprise a clip having a portion which embraces said article and which interconnects said legs.

* * * * *